US005570972A

United States Patent [19]

Glass et al.

[11] Patent Number: 5,570,972

[45] Date of Patent: Nov. 5, 1996

[54] TRAFFIC BARRICADE AND FLASHER LIGHT ASSEMBLY WITH COMBINATION FLASHER LIGHT MOUNTING APPARATUS AND CARRYING HANDLE

[75] Inventors: Geoffrey M. Glass, Rolling Meadows, Ill.; Wayne J. Brocka; Douglas C. Madsen, both of Shell Rock, Iowa

[73] Assignee: Plasticade Products Corporation, Rolling Meadows, Ill.

[21] Appl. No.: 382,485

[22] Filed: Feb. 1, 1995

[51] Int. Cl.[6] ..... E01F 9/00

[52] U.S. Cl. ..... 404/6; 404/10; 256/64; 116/63 R; 116/63 P

[58] Field of Search ..... 404/6, 10; 256/13.1, 256/64; 40/606, 612; 116/63 P, 63 R; 16/124, 125, DIG. 16, DIG. 24; 49/460; 190/118–122; 294/143, 169

[56] References Cited

U.S. PATENT DOCUMENTS

| | | |
|---|---|---|
| D. 60,293 | 1/1922 | Meden . |
| D. 235,744 | 7/1975 | England . |
| D. 272,809 | 2/1984 | Bent et al. . |
| D. 276,510 | 11/1984 | Bent et al. . |
| D. 279,275 | 6/1985 | Cory . |
| D. 320,172 | 9/1991 | Thurston . |
| 2,456,685 | 12/1948 | Delmotte . |
| 2,483,734 | 10/1949 | Neal . |
| 2,649,803 | 8/1953 | Andre . |
| 2,762,327 | 9/1956 | Weig . |
| 2,762,328 | 9/1956 | Weig . |
| 2,808,803 | 10/1957 | Weig . |
| 2,817,308 | 12/1957 | Scanlon . |
| 2,957,444 | 10/1960 | Boettler . |
| 3,099,244 | 7/1963 | Knapp . |
| 3,231,994 | 2/1966 | Cyrus . |
| 3,380,428 | 4/1968 | Abrams . |
| 3,451,368 | 6/1969 | Keats . |
| 3,499,413 | 3/1970 | Heard . |

(List continued on next page.)

FOREIGN PATENT DOCUMENTS

| | | |
|---|---|---|
| 216329 | 12/1956 | Australia . |
| 1240545 | 8/1988 | Canada . |
| 665785 | 1/1952 | United Kingdom . |
| 1058881 | 2/1967 | United Kingdom . |
| 1301084 | 12/1972 | United Kingdom . |
| 2077332 | 12/1981 | United Kingdom . |
| 2081348 | 2/1982 | United Kingdom . |
| 2090313 | 7/1982 | United Kingdom . |
| 2122239 | 1/1984 | United Kingdom . |
| 2156409 | 10/1985 | United Kingdom . |
| 2182701 | 5/1987 | United Kingdom . |

OTHER PUBLICATIONS

Brochure No. M790, published by Best Barricade Rolling Meadows, Illinois.

Brochure, published by Best Barricade, Rolling Meadows, Illinois.

Visual Warnings literature, Catalog S–10, pp. 71–72.

Catalog Page, published by Bent Manufacturing Company, Compton, California in 1990.

Specification Sheet published by Roadmarker/Contico in 1981.

(List continued on next page.)

*Primary Examiner*—William P. Neuder
*Assistant Examiner*—Pamela A. O'Connor
*Attorney, Agent, or Firm*—Willian Brinks Hofer Gilson & Lione

[57] ABSTRACT

A combination mounting flange and handle for attaching a flasher light unit to a plastic traffic barricade is disclosed herein. A handle is integrally molded to each of the barricade panels to allow for convenient dismantling and transportation of the barricade. A flange is molded onto each handle so that a flasher light unit may be affixed to a handle using a fastening bolt. The position of the mounted flasher light unit near the cross-bars of the barricade prevents the unit from being knocked out of placement by common road or construction disturbances. The shape and position of the handle allows for simplified usage and easier access to the fastening bolt by the user.

15 Claims, 2 Drawing Sheets

U.S. PATENT DOCUMENTS

| | | | |
|---|---|---|---|
| 3,520,235 | 7/1970 | Palazzolo . | |
| 3,563,445 | 2/1971 | Clayton . | |
| 3,619,443 | 11/1971 | Feldman . | |
| 3,701,456 | 10/1972 | Alroy . | |
| 3,751,852 | 8/1973 | Schrepper . | |
| 3,809,007 | 5/1974 | Brown . | |
| 3,822,668 | 7/1974 | Schradieck et al. . | |
| 3,825,114 | 7/1974 | Johnson et al. . | |
| 3,880,406 | 4/1975 | Stehle et al. | 254/64 |
| 3,916,816 | 11/1975 | Fitch . | |
| 3,949,701 | 4/1976 | Teixeira . | |
| 3,950,208 | 4/1976 | Pavuk et al. . | |
| 3,952,690 | 4/1976 | Rizzo et al. . | |
| 4,006,702 | 2/1977 | St. Cyr . | |
| 4,007,919 | 2/1977 | Totten . | |
| 4,040,759 | 8/1977 | Skalle . | |
| 4,054,207 | 10/1977 | Lazure et al. . | |
| 4,083,033 | 4/1978 | Kulp et al. . | |
| 4,102,453 | 7/1978 | Carroll et al. . | |
| 4,120,398 | 10/1978 | Braddon, Sr. . | |
| 4,134,533 | 1/1979 | Heavner . | |
| 4,175,661 | 11/1979 | Barnes . | |
| 4,197,808 | 4/1980 | Kinninger . | |
| 4,239,137 | 12/1980 | Arcouette . | |
| 4,256,050 | 3/1981 | Barnard . | |
| 4,291,830 | 9/1981 | Sorensen . | |
| 4,298,186 | 11/1981 | Glass | 256/64 |
| 4,317,617 | 3/1982 | Charlton . | |
| 4,329,800 | 5/1982 | Shuman . | |
| 4,334,616 | 6/1982 | Wilson . | |
| 4,418,863 | 12/1983 | Kimbrell, Sr. . | |
| 4,441,615 | 4/1984 | Goodrich . | |
| 4,466,376 | 8/1984 | Wells . | |
| 4,516,109 | 5/1985 | Thurston | 340/114 |
| 4,520,928 | 6/1985 | Wilson . | |
| 4,570,798 | 2/1986 | Wilson . | |
| 4,624,210 | 11/1986 | Glass | 116/63 |
| 4,674,431 | 6/1987 | Cory . | |
| 4,792,258 | 12/1988 | Goff . | |
| 4,852,511 | 8/1989 | Look et al. . | |
| 4,973,190 | 11/1990 | Erwin et al. | 404/10 |
| 4,974,815 | 12/1990 | Glass | 254/64 |
| 5,003,912 | 4/1991 | Thurston . | |
| 5,009,541 | 4/1991 | Thurston . | |
| 5,036,791 | 8/1991 | Thurston . | |
| 5,046,885 | 9/1991 | Thurston . | |
| 5,342,140 | 8/1994 | Glass | 404/9 |
| 5,458,434 | 10/1995 | Bent et al. . | |

OTHER PUBLICATIONS

Illustration from Best Barricade Price List published by Best Barricade on May 1, 1981.

Doc. # 11207 Through 11214–Produced By Flasher Flare South East, Inc. As A Price List. Dated Oct. 17, 1991, Total Of 8 Pages. Produced In Hillsborough County, Florida.

Doc. # 11346 Through 11352–Produced By Traffic Safety Services As Sales Brochure. Dated Prior To 1991, Total of 7 Pages. Produced In South Plainfield, New Jersey.

Doc. # B0384 Throught B0391–Produced By Best Barricades As Sales Brochure. Dated Prior To 1992. Total of 8 Pages. Produced In Rolling Meadows, Illinois.

TRAFFIC BARRICADE AND FLASHER LIGHT ASSEMBLY WITH COMBINATION FLASHER LIGHT MOUNTING APPARATUS AND CARRYING HANDLE

FIELD OF THE INVENTION

This invention relates in general to traffic barricades. It relates particularly to foldable traffic barricades having flasher light units mounted thereon.

BACKGROUND OF THE INVENTION

Portable folding traffic barricades are now widely utilized to control traffic or protect vehicles from road hazards. Made from plastic or metal and wood combinations, these barricades typically comprise two generally planar panel members fastened together at one end by hinge members and hinge bolts. The hinges allow the barricades to be opened for use or folded flat for more convenient storage or transport.

Plastic barricades are sometimes manufactured through a rotational or blow molding process wherein each panel is molded individually into a single, hollow piece. The use of plastic results in a barricade with many advantages over those made from metal and wood combinations, including light weight and durability. The use of plastic also reduces the amount of damage to a vehicle if the barricade is inadvertently struck. Furthermore, the two-panel general configuration of these plastic barricades allows it to collapse into its folded position if struck by a vehicle. This allows the striking vehicle and the other vehicles that follow to drive over the folded barricade safely.

To promote visibility, traffic barricades are often fitted with a standard-sized flasher light unit. The flasher light unit generally comprises a housing containing a battery, and a lens containing a bulb and reflector. The unit is usually attached to one of the hinge bolts on the barricade via a threaded socket in the housing.

When a flasher light unit is attached directly to one of the barricade's hinge bolts, the possibility of theft of the flasher light unit becomes a problem. The hinge bolt is easily removed by a would-be thief because the head of the bolt is exposed on one end of the hinge member. This configuration can also be difficult to maintain and install because the various manufacturers of barricades use hinge bolts of differing sizes.

While some barricades attach the flasher light unit directly to a hinge bolt, some prior art traffic barricade/flasher light combinations attach the flasher light unit to the hinge bolt using a small mounting bracket. The mounting bracket acts as an adapter to allow flasher light units to be mounted to plastic or metal barricades from different manufacturers. The bracket also allows users easier access to the flasher light unit for maintenance.

Prior art barricades which use brackets such as hereinbefore described have shortcomings, however. They allow the flasher light unit to rotate out of proper position for easier maintenance access, but this feature allows the flasher light assembly to be jarred out of its proper position. Although some assemblies that utilize brackets require significant force to knock the flasher light out of position, once this occurs, the mispositioned flasher light casts its beam in improper directions. This can be both uneconomical and dangerous.

The prior art bracket/light combinations have other disadvantages. Because a separate bracket is used to mount the flasher light unit, the barricade user has more parts to keep track of, install and maintain. The inconvenience becomes especially severe where hundreds of barricades are placed in use, as they often are.

Theft of the comparatively expensive flasher light assembly also remains a primary concern of barricade users. The fastening bolt, even though it often has a theft-proof head configuration and is not engageable by a conventional socket wrench, can still be removed by thieves when used with a mounting bracket. When such a bracket is used, the head of the fastening bolt is accessible when the bracket and light are rotated out of position. The cupped recess in the bracket only partially conceals the head, allowing a determined thief to remove the bolt with a conventional set of pliers.

The preferred embodiment of the present invention provides an improved molded plastic barricade with a molded handle member which also serves as a flasher light mounting apparatus. This simplified structure does not require a separate bracket to attach the flasher light unit, although one may be used. The flasher light unit thus has greater stability and is more easily maintained. This configuration also more effectively conceals the head of the fastening bolt, thereby hindering theft of the flasher light unit. Moreover, the handle member itself greatly simplifies carrying and storage of the barricade.

It is an object of the invention to provide an improved and simplified flasher light mounting assembly for traffic barricades.

It is another object to provide a convenient means for carrying or transporting a traffic barricade.

It is another object to provide a mounting assembly which prevents the flasher light from slipping into an improper position during use.

It is still another object to provide a mounting assembly which hinders unauthorized removal or theft of the flasher light from the barricade.

BRIEF SUMMARY OF THE INVENTION

One aspect of the present invention is embodied in an improved traffic barricade and flasher light mounting assembly having a combination flasher light mounting apparatus and carrying handle. The assembly includes a flasher light unit and traffic barricade. The barricade has a pair of hollow planar leg panels molded from plastic. The panels each comprise two upstanding legs interconnected by horizontal cross-bars. A pair of hinge members project from the upper cross-bar.

The barricade configuration utilizes two opposing panel members. Opposing hinge members from each panel member are hingeably connected together by a hinge bolt, thereby comprising a free-standing, foldable barricade unit.

In the preferred embodiment illustrated and described, an upstanding handle member of an inverted U-shape configuration is preferably integrally molded with the top surface of the upper cross-bar of each panel member. The handle member is located between the pair of hinge members on each panel member and extends at an angle obtuse to the plane of the panel members. When the opposing panel members are hinged together, the resulting structure of opposing handle members provides a convenient means for carrying the barricade with one hand.

Each handle member has a molded plastic flange projecting outward from the handle member (towards the opposing handle member). The flange acts as a receptacle for a conventional flasher light unit. The flange is of a planar configuration and is positioned perpendicular to the plane of the handle member. The flange itself comprises a front wall and a rear wall with a hollow space between the walls. A round aperture, reinforced with a thicker rim of plastic, is centered in the flange.

The conventional flasher light unit is mounted to the handle by a fastening bolt inserted through the round aperture in the flange. The bolt then screws into a threaded socket in the lower portion of the flasher light unit. When tightened, the head of the bolt is concealed within the structure of the opposing handle members, thus deterring theft. Removal of the fastening bolt through the use of pliers is much more difficult in this configuration. However, when a properly matched socket wrench is used, the bolt is easily removed by inserting the wrench through the carrying opening in one of the handle members.

The base of the flasher light unit sits in close proximity to the top or rests on top of the panel member. In this position, the flasher light unit cannot rotate more than a few degrees out of its proper orientation.

The handle molded on the barricade allows for easy manipulation and transport, while allowing space for the flasher light unit to be mounted on the top of the barricade. Prior art plastic barricades which have handles do not allow for such space.

DESCRIPTION OF THE PREFERRED EMBODIMENT

Figure 1:
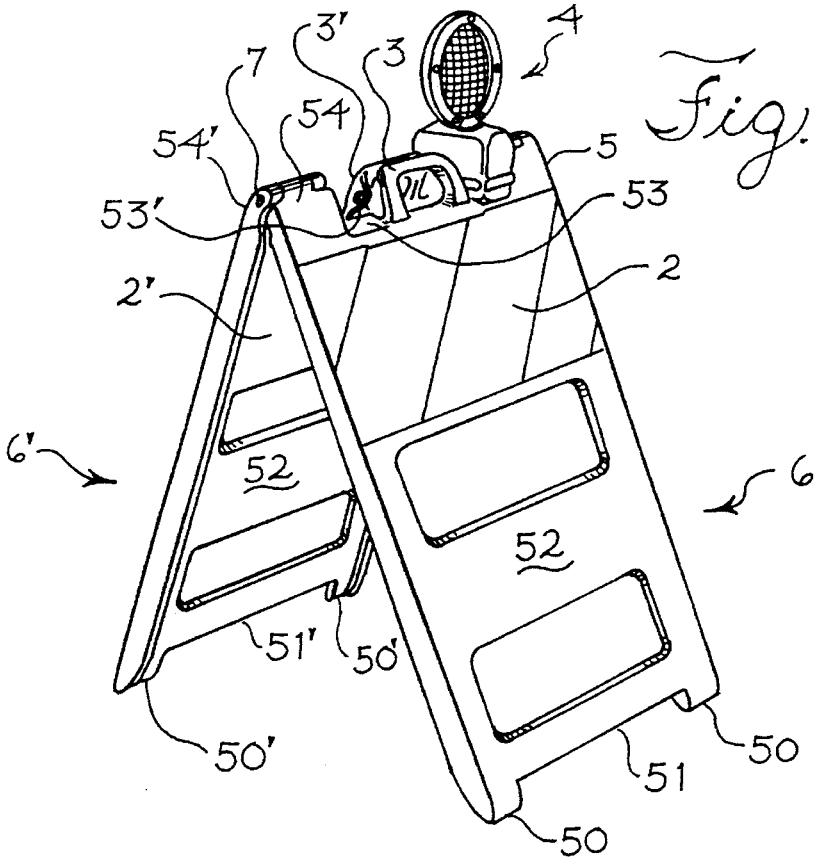
FIG. 1 is a perspective view of a molded plastic traffic barricade showing a flasher light unit mounted to the handle member of the present invention.

Referring now to the drawings, FIG. 1 shows a molded plastic traffic barricade embodying the invention. Opposing panel members 6 and 6' are each comprised of a pair of vertical leg bars 50 and 50', each connected by horizontal cross-bars 51 and 51' at the bottom, upper cross-bars 2 and 2', and 52 and 52' in between. Each panel member also has a top surface 53 and 53' located on top of upper cross-bars 2 and 2'. Molded hinge members 5, 54, 5' and 54' project from the top of the panel members and are positioned above the vertical leg bars 50 and 50'. The hinge members are typical of those in the art, for example in U.S. Pat. No. 4,624,210, which is incorporated herein by reference. Handle member 3 projects from top surface 53, and handle member 3' projects from top surface 53' at angles obtuse to the plane of each respective panel member 6 and 6'. The handle members 3 and 3' are made from plastic and integrally molded to their respective panel members.

Opposing panel members 6 and 6' are hinged together by mating the hinge members 5, 54, 5' and 54' and inserting a hinge bolt 7 into each mated hinge pair. In this configuration, panel members 6 and 6' may either lie flat against each other in a folded position, or opened as shown. As described in U.S. Pat. No. 4,624,210, the construction of the hinge members restricts the angle at which the panel members can separate and secures the barricade in an open position.

FIG. 1 also shows flasher light unit 4 mounted to handle member 3. As described below, the unit may be positioned on either side of the handle members 3 and 3'.

Figure 2:
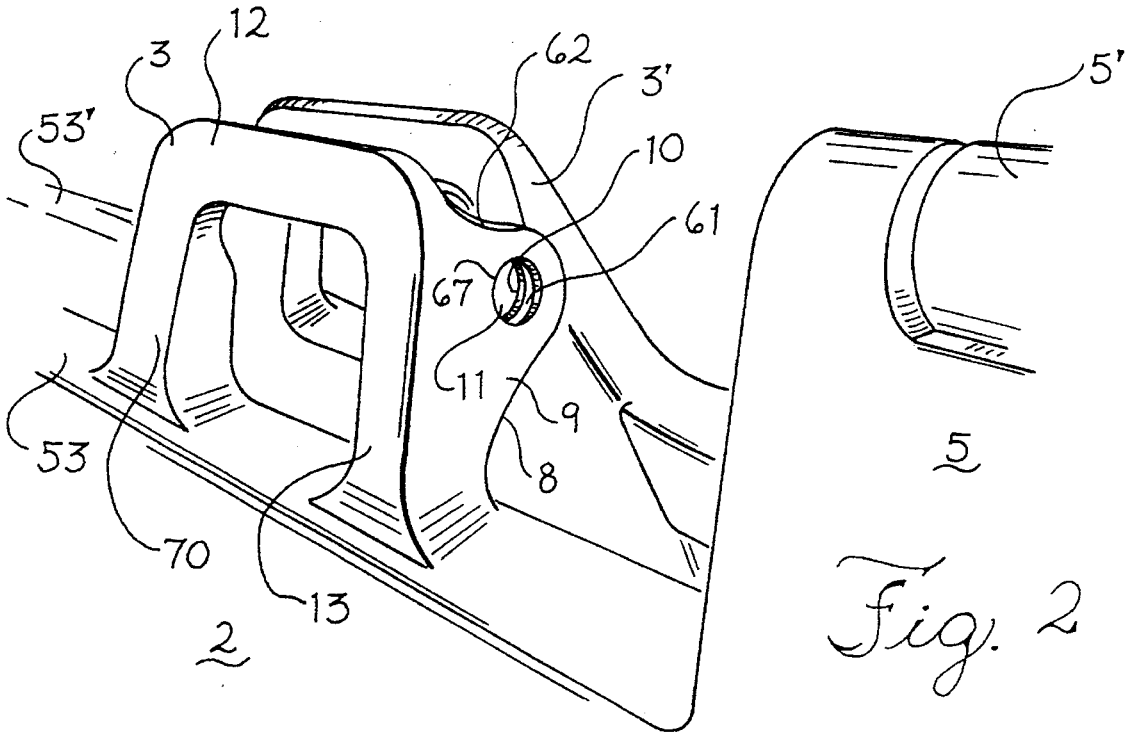
FIG. 2 is a perspective view showing the handle member, flange, and aperture of the present invention.
Figure 3:
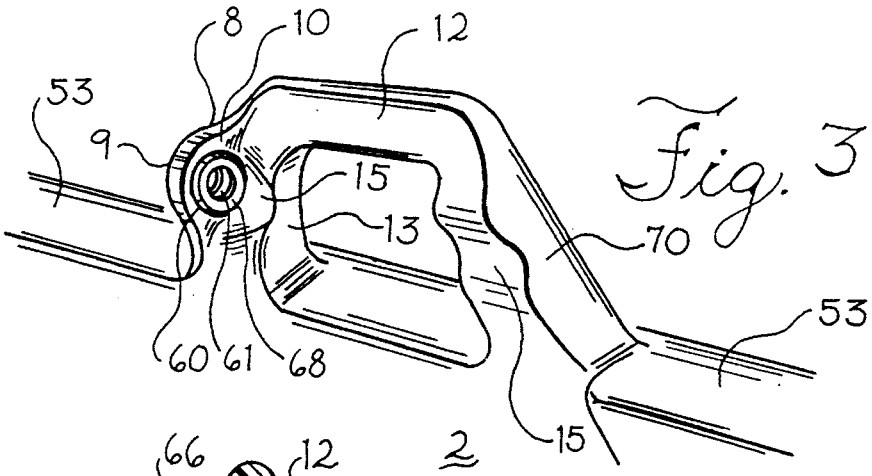
FIG. 3 is a side view showing the handle member configuration of the present invention.

FIGS. 2 and 3 illustrate in detail the configuration of one of the handle members 3 and the flange 8 on the handle member 3, which is a receptacle for the flasher light unit 4. As these figures show, the handle member 3 is an inverted "U" shape having upright side portions 13 and 70 of approximately equal length. The side portions are molded to the top surface 53 of the upper horizontal panel member 2, and bridged by a substantially horizontal connecting bar 12.

Figure 4:
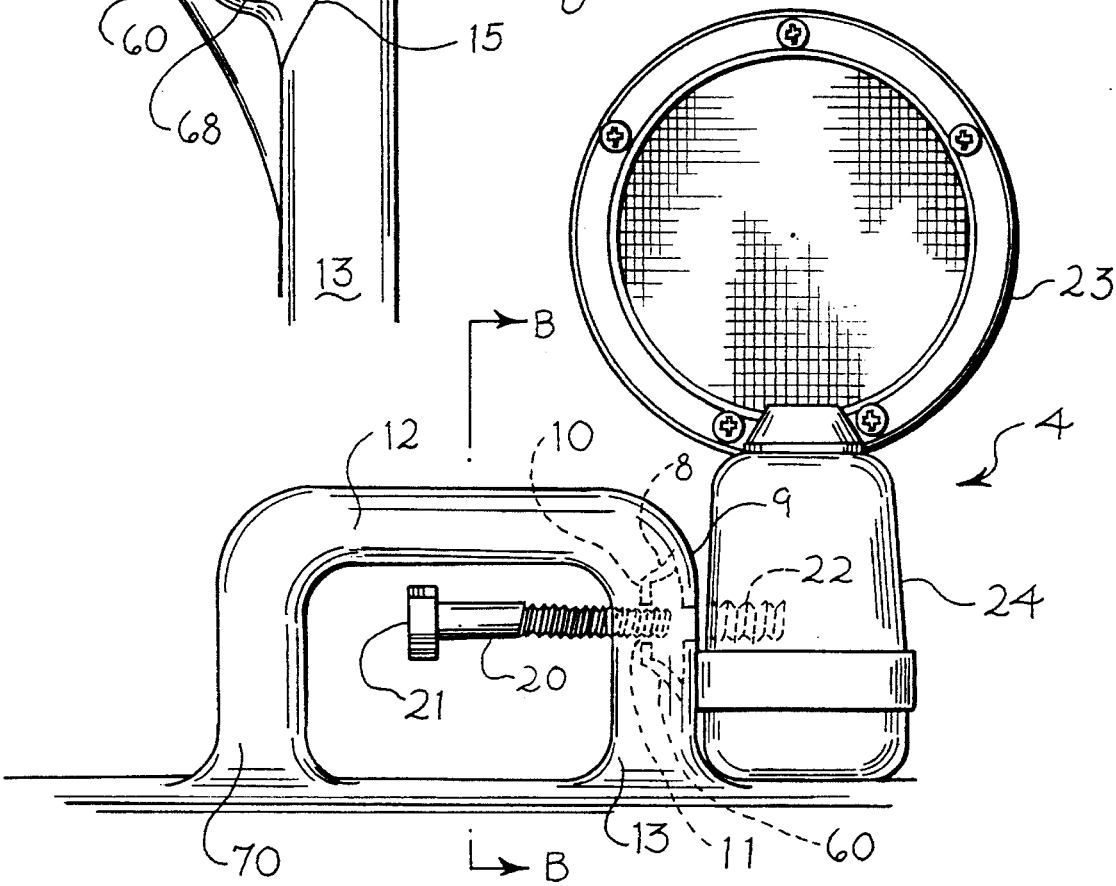
FIG. 4 is an exploded side view of the invention showing how the flasher light unit is mounted to the flange on the handle using a fastening bolt.

A molded flange 8 is attached to the right side portion 13 of handle member 3. The flange 8 is of a generally planar configuration and projects perpendicularly from the plane of the handle member. The shape of the flange as defined by the molded sidewall 62 is an inverted teardrop shape. Front wall 9 and rear wall 10 comprise the planar portion of the flange, which is molded to be hollow. Thus, an open space 61 is present in between the two walls in the interior of the flange. A round aperture 11 is molded into the flange 8 and pierces both walls 9 and 10. More specifically, two concentric apertures are present, aperture 67 in front wall 9 and aperture 68 in rear wall 10. The rear wall 10 of the flange is gradually thickened with plastic to a thickness of 4 mm in the area immediately surrounding the aperture 68 in order to provide reinforcement for both the flange and the aperture. This thickened area is shown at 60. The open space 61 allows the flange to show some resiliency around the aperture 11. This feature eases some of the clamping pressure from the mounted flasher light unit and the head portion 21 of fastening bolt 20 as shown in FIG. 4. This allows the fastening bolt to be tightened without the bolt gouging the plastic around the aperture. Damage to the aperture 11 during normal use or jarring impact is thus minimized.

FIG. 4 illustrates the mounting of the flasher light unit 4 to the flange 8. The conventional flasher light unit 4 comprises a lower housing 24 and a lamp housing 23. A threaded socket 22 is disposed within the lower housing 24 to accept threaded fastening bolt 20. Head portion 21 of the fastening bolt 20 is of a theft-proof configuration that is not engageable by a standard socket wrench. To mount the flasher light unit, fastening bolt 20 is passed through the aperture 11 of the flange 8 and into the threaded socket 22 of the lower housing 24. As the fastening bolt 20 is tightened to the flange, the front wall 9 and rear wall 10 of the flange are deformed slightly near the aperture 11. Once the bolt is secured, head portion 21 rests tightly against rear wall 10, and the lower housing 24 rests tightly against front wall 9. Mounted in this fashion, the bottom of the flasher light unit is only a few millimeters above the top surface 2, and cannot rotate more than a few degrees out of proper vertical position on the barricade.

Figure 5:
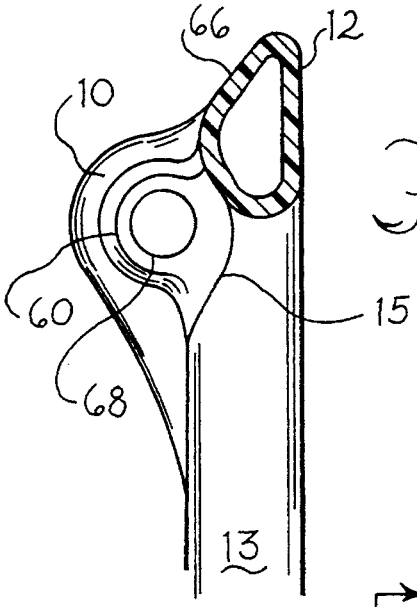
FIG. 5 is a side view of the invention taken along line B—B of FIG. 4 showing the tapers in the handle member to allow access to the head of the fastening bolt.

When the head portion 21 of the fastening bolt 20 is tightened against the rear wall 10 of the flange 8, the head is concealed beneath the structure of the handle member 3 and opposing handle member 3' as shown in FIG. 1. The user may easily access the head portion 21 of the fastening bolt 20 from underneath either of the handle members or from either side of the handle members, depending on whether the barricade is open or closed. In order to further facilitate the engaging of the head portion 21 by a special socket wrench and to allow more clearance for rotation of the head portion, notches 15 are disposed on the rear side of side portions 13 and 70. One of these notches is visible in FIG. 5.

Finally, in order to provide more room for the user's fingers when installing the flasher light unit, and to allow the user to more clearly see the fastening bolt 20 from overhead during installation, the rear surface of the connecting bar 12 and the side portions 13 and 70 of the handle member 3 are tapered slightly. The cross-section of the connecting bar is thus of a generally triangular shape, with rounded angles to make carrying more comfortable. These features are shown as tapered portion 66 in FIG. 5.

Although the preferred embodiment of the invention has been disclosed, the invention is not limited to such an embodiment. The scope of the invention is indicated by the appended claims rather than the foregoing description, and all changes which come within the meaning and range of equivalency of the claims are therefore intended to be embraced therein.

We claim:

1. A traffic barricade assembly comprising:

a pair of panel members, each having a top surface, said panel members hingeably connected together;

a handle member upstanding from the top surface of at least one of said panel members, said handle member having an inverted "U" shape including two side portions extending substantially upward from the top surface of said panel member, and a substantially horizontal connecting bar connecting said side portions;

a flange on said handle member; and a flasher light unit attached to said handle member via said flange.

2. A traffic barricade assembly according to claim 1 further characterized in that said flange extends outward from at least one of said side portions.

3. A traffic barricade assembly according to claim 2 further characterized in that said flange defines an aperture.

4. A traffic barricade assembly according to claim 3 further characterized in that said aperture is encircled by a thickened rim area adjacent to said aperture.

5. A traffic barricade assembly according to claim 3 further comprising a fastening bolt having a head portion, said fastening bolt extending through said aperture and into said flasher light unit.

6. A traffic barricade assembly according to claim 5 wherein the connecting bar of said handle member is of a generally triangular cross section.

7. A traffic barricade assembly according to claim 5 wherein the side portions of said handle member each define a notch to provide clearance for the head of said fastening bolt.

8. A traffic barricade assembly according to claim 2 wherein said flange extends perpendicularly from the plane of said handle member.

9. A traffic barricade assembly according to claim 1 further characterized in that said flange comprises a front wall and a rear wall, said front wall and rear wall defining an open space therebetween.

10. A traffic barricade assembly according to claim 1 wherein the panel members and the handle member are constructed of molded plastic.

11. In a traffic barricade assembly wherein the barricade includes a pair of generally planar panel members, each panel member having an upper cross-bar and a top surface on said upper cross-bar, opposed hinge members extending upwardly from the cross-bars, the opposed hinge members being hingeably connected together, a flasher light unit having a threaded socket, the improvement comprising:

a handle member on at least one of said cross-bars extending upwardly from said top surface, said handle member having an inverted "U" shape including two side portions extending substantially upward from the top surface of said panel member, said side portions connected by a substantially horizontal connecting bar;

a flange extending perpendicularly from the plane of said handle member, said flange having an aperture; and a fastening bolt extending through said aperture and into the threaded socket of said flasher light unit.

12. The improvement recited in claim 11 wherein the connecting bar of said handle member is of a generally triangular cross section.

13. The improvement recited in claim 11 wherein the side portions of said handle member each define a notch to provide clearance for the head of said fastening bolt.

14. The improvement recited in claim 11 further characterized in that said aperture is encircled by a thickened rim area adjacent to said aperture.

15. The improvement recited in claim 11 further characterized in that said flange comprises a front wall and a rear wall, said front wall and rear wall defining an open space therebetween.

* * * * *